United States Patent [19]

Kellett

[11] Patent Number: 4,474,236

[45] Date of Patent: Oct. 2, 1984

[54] METHOD AND APPARATUS FOR REMOTE INSTALLATIONS OF DUAL TUBING STRINGS IN A SUBSEA WELL

[75] Inventor: Rodney Kellett, Leeds, England

[73] Assignee: Cameron Iron Works, Inc., Houston, Tex.

[21] Appl. No.: 469,093

[22] Filed: Feb. 23, 1983

[30] Foreign Application Priority Data

Mar. 17, 1982 [GB] United Kingdom ..... 8207727

[51] Int. Cl.[3] ..... E21B 23/00; E21B 33/035

[52] U.S. Cl. ..... 166/250; 166/313; 166/341; 166/348; 166/382

[58] Field of Search ..... 166/250, 313, 337, 341, 166/344, 345, 348, 362, 368, 378, 379, 381, 382, 383

[56] References Cited

U.S. PATENT DOCUMENTS

| | | | |
|---|---|---|---|
| 3,661,206 | 5/1972 | Putch et al. | 166/313 |
| 3,741,294 | 6/1973 | Morrill | 166/382 |
| 3,971,576 | 7/1976 | Herd et al. | 166/368 |
| 4,284,142 | 8/1981 | Kirkland | 166/344 |
| 4,298,067 | 11/1981 | Lawson | 166/382 |
| 4,333,531 | 6/1982 | Lawson | 166/382 |
| 4,340,117 | 7/1982 | Lawson | 166/382 |
| 4,353,420 | 10/1982 | Miller | 166/382 |

*Primary Examiner*—Stephen J. Novosad
*Assistant Examiner*—William P. Neuder
*Attorney, Agent, or Firm*—Vinson & Elkins

[57] ABSTRACT

An improved method of completing a well having production and service strings of different sizes including the steps of running the production string on a main tubing hanger while controlling the well with a variable bore blowout preventer and running the service string into the tubing hanger while controlling the well with a dual bore blowout preventer.

An improved apparatus for completing a well having producing and service strings of different sizes including a main tubing hanger running tool having a removable connection on its lower end to connect to the main tubing hanger, a main bore, an upward tubular extension aligned with the main bore and of sufficient length to extend through the dual bore blowout preventer when the main tubing hanger is seated in the pressure ducts for testing and control of the main and service line tubing hangers, a service line bore offset from the main bore, hose connections at the top of the tubular extension, and parts to register with parts on the service line tubing hanger.

6 Claims, 14 Drawing Figures

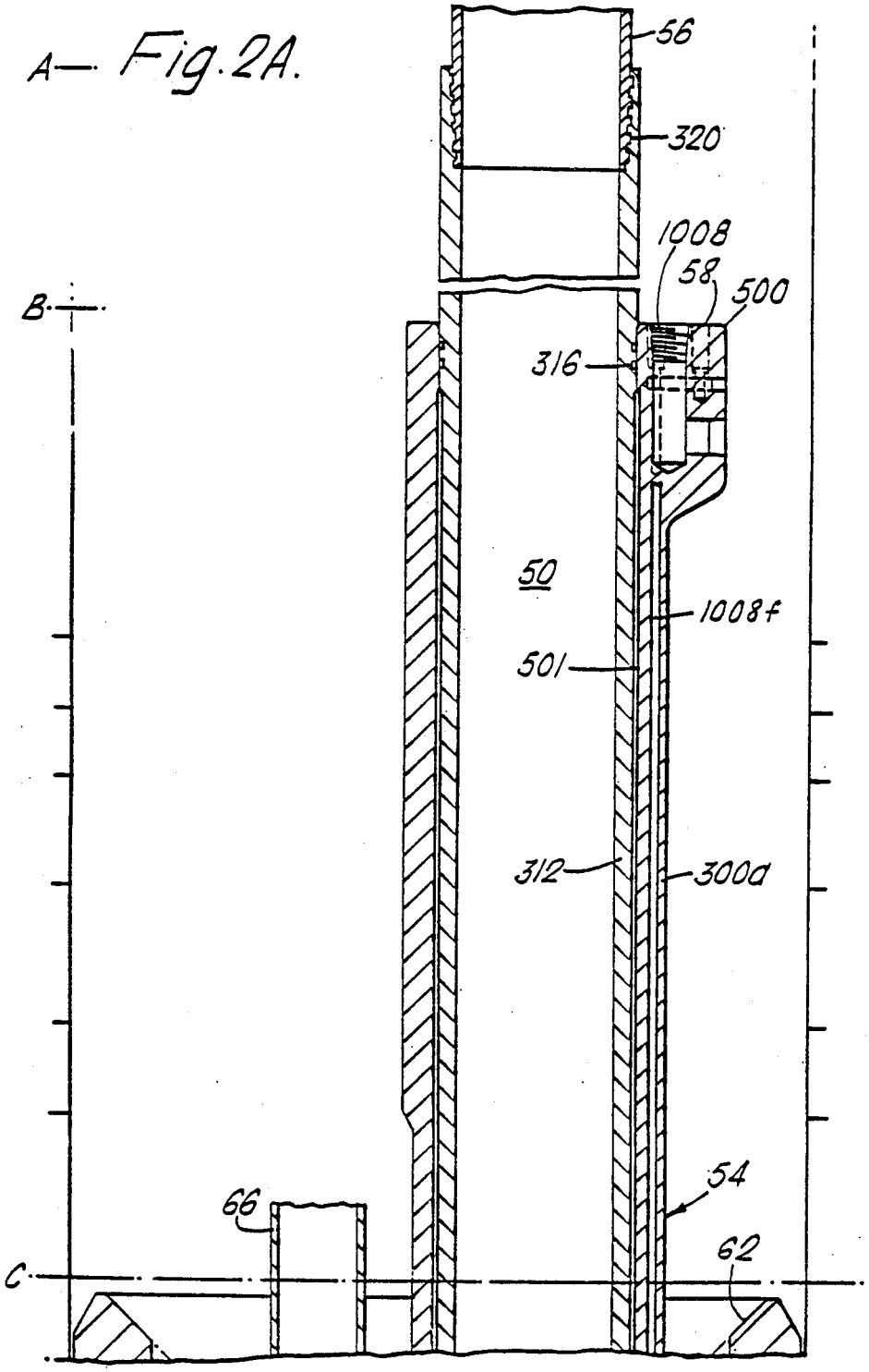
A— Fig. 2A.
56
320
1008
58
500
B
316
50
1008f
501
312
300a
54
66
62
C 1003f, 1014f
1002f, 1013f
108
F.
302
1003l
552
1014l
1002f
1013f
310
112
G.
100
40'
28
34

METHOD AND APPARATUS FOR REMOTE INSTALLATIONS OF DUAL TUBING STRINGS IN A SUBSEA WELL

BACKGROUND

The present invention relates to a method and apparatus for remote installation of dual tubing strings in a subsea well with all operations remote controlled from the surface.

Particularly with subsea wells, it is desirable to maintain control by means of the blowout preventers throughout the running of the tubing strings. Dual strings of the same size have been run together on a tubing hanger with the aid of a tubing hanger running tool, maintaining control with a dual bore blowout preventer.

In offshore completions it can be desirable to have a 4" production string and a 2" service or T.F.L. (through flow line) string or other combinations of different sizes. If it were attempted to run such strings together, it would be difficult to maintain their orientation with respect to a dual bore blowout preventer construction for the different sized strings.

It has been proposed in U.S. Pat. No. 4,284,142 to run different sized strings together, and these are brought through a composite handling joint: blowout preventers cooperate with the handling joint only after the string is landed.

SUMMARY

The invention provides a method for completing a well having production and service strings of different sizes including the steps of running the production string on a main tubing hanger and maintaining control with a variable bore blowout preventer and then running the service string into the tubing hanger and maintaining control with a dual bore blowout preventer with the two strings oriented. Orientation is effected by an orientation bushing as the main tubing hanger is landed.

In a preferred construction, the main tubing hanger is run on a main running tool having an upward tubular extension or mandrel which, when the hanger is seated, extends upwardly through the dual bore blowout preventer and contains all necessary hydraulic pressure ducts for testing and control. The service string is then run on its own service line tubing hanger with the aid of a service line running tool, the service line tubing hanger seating in a main tubing hanger. During running of the service line, control is maintained by the dual bore preventer acting on the extension of the main tubing hanger running tool, and the service line. All control and testing functions can be carried out with the aid of hydraulic pressure acting through the ducts above mentioned, and through registering ports and ducts in the running tools and hangers.

For use in the method just outlined, the invention provides a main tubing hanger comprising (1) means for attachment to a lockdown seal assembly,
(2) a main bore offset with regard to the hanger axis, means centered on the main bore for connection to a production string,
(3) means centered on the hanger axis for connection to a main tubing hanger running tool, and
(4) a service line bore providing means for locating a service line tubing hanger and for receiving a service line tubing hanger running tool.

The invention also provides a main tubing hanger running tool, for use in the method outlined, and with the hanger referred to in the last paragraph:

this tool comprises:

(1) a lower end for removable connection to the main tubing hanger,
(2) a main bore for alignment with the production string,
(3) an upward tubular extension aligned with the main bore which, when the hanger is seated, extends upwardly through a dual bore blowout preventer and contains hydraulic pressure ducts for testing and control of the main and service line tubing hangers and presents an exterior adapted for cooperation with the blowout preventer rams,
(4) a service line bore offset from the main bore and for alignment with the service line tubing hanger when the latter is seated in the main tubing hanger,
(5) connection means at the top of the extension for connection to pressure hoses, and
(6) port means including ports at the service line bore to register with ports on the service line tubing hanger and for a running tool therefor for control and testing of the service line hanger.

Further features of the invention will appear from the following description of a preferred embodiment.

The main object of the invention is to provide a reliable and relatively simple method and apparatus for completing a well with dual strings of different sizes while maintaining control of the well by blowout preventers as the strings are run.

Another object of the present invention is to provide an improved method of installing dual strings of different sizes in a subsea well wherein the strings are run separately.

A further object is to provide an improved method of and apparatus for completing a subsea well having production and service strings of different sizes simply and quickly without problems of orientation or sacrificing control of the well.

BRIEF DESCRIPTION OF THE DRAWINGS

Preferred embodiments of the invention will be described with reference to the accompanying drawings given by way of example.

FIG. 2 is divided into four parts, 2A, 2B, 2C and 2D, going from the upper to the lower end;

DESCRIPTION OF THE PREFERRED EMBODIMENT

Figure 1:
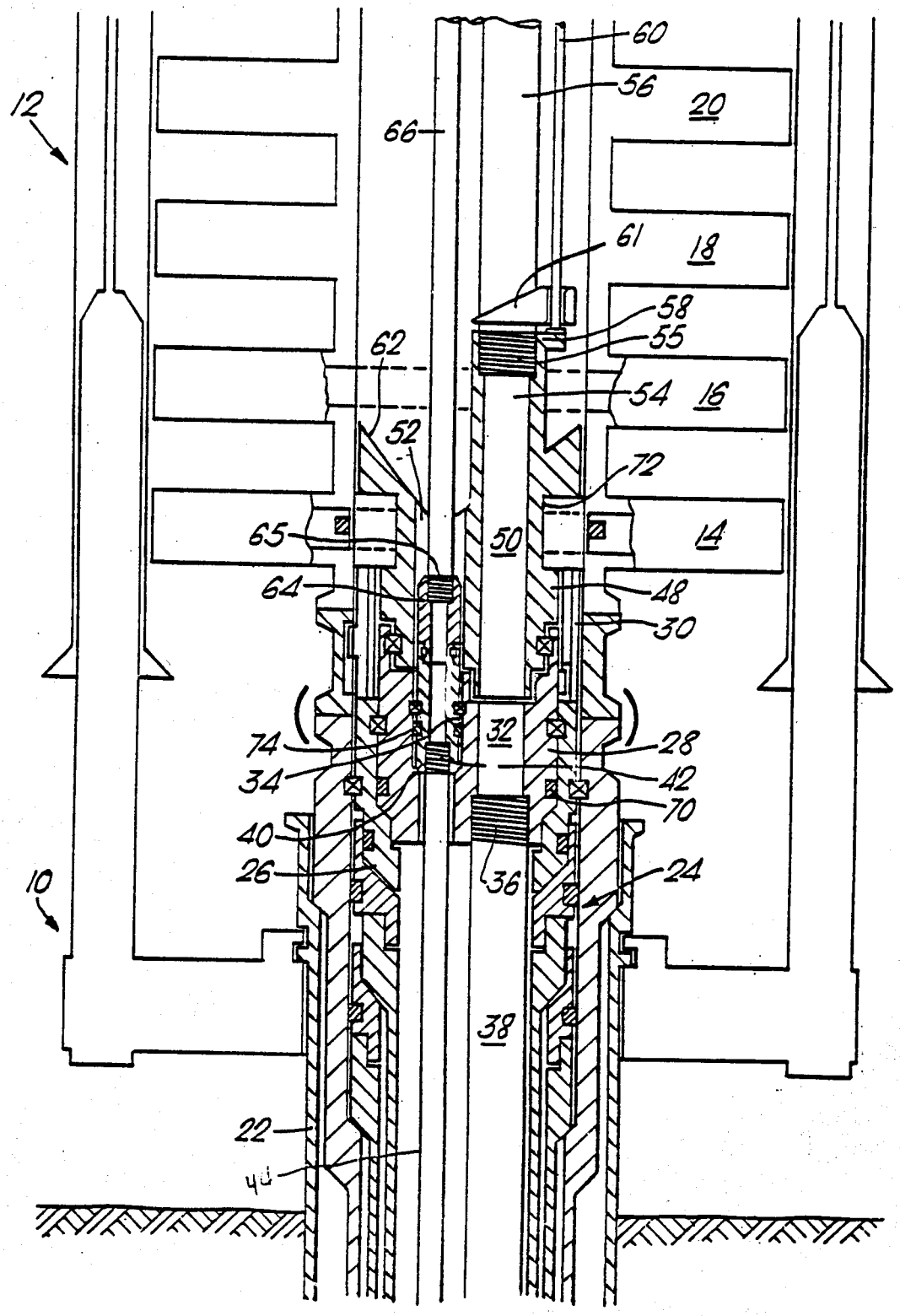
FIG. 1 is a diagrammatic sectional view of a wellhead with a blowout preventer stack, showing production and service tubing strings installed on tubing hangers, with the running tools, running strings and control hoses in position, the section being taken on a diametral plane containing the axes of the production and service strings.

Referring first to FIG. 1, there is shown a wellhead designated generally 10, carrying a blowout preventer stack designated generally 12, the stack comprising in sequence going from the bottom to the top, 13⅜" casing rams 14, 6⅝" and 2⅜41 dual bore rams 16, variable bore rams 18, and blind shearing rams 20. The wellhead comprises a 30" conductor 22 housing an assembly 24 of casing hangers surmounted by a lockdown seal assembly 26. A main tubing hanger designated generally 28 is located within the seal assembly 26; an orientation bushing 30 located above the seal assembly rotates the main tubing hanger to a predetermined angular position as the hanger is lowered on to the seal assembly.

Figure 2B:
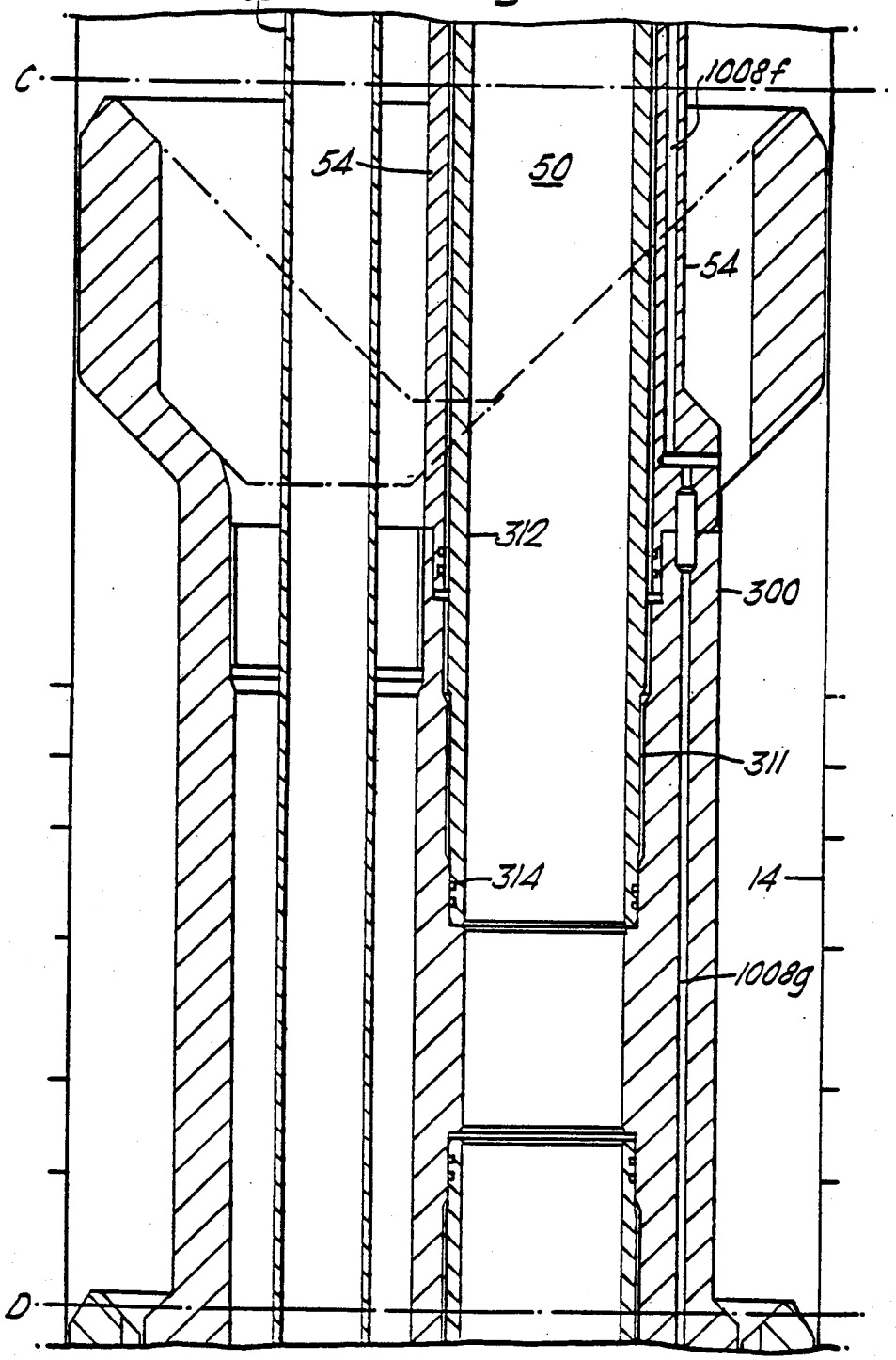
FIG. 2 is a sectional view in more detail of the tubing hangers and running tools and certain adjacent parts.

The main tubing hanger 28 has a main bore 32 offset from the axis of the tubing hanger, and a smaller service line bore 34 also offset. The sections of FIGS. 1 and 2 are taken through the axes of these bores 32, 34. The lower end of the main tubing hanger supports at 36 a 4" production tubing string 38 in alignment with the main bore 32. The main tubing hanger 28 is adapted to receive and support in the service line bore 34 a service line tubing hanger 40 which in turn supports at 42 a 2" service line string 44 aligned with the service line bore.

A main tubing hanger running tool 48 is connected to the main tubing hanger and has a main bore 50 in alignment with the main bore 32 in the main tubing hanger and also a service line bore 52 in alignment with the service line bore 34 in the main tubing hanger. The main tubing hanger running tool 48 has an upwardly extending mandrel 54 with a generally cylindrical exterior, which is connected at its upper end, as shown at 55, to a 4" production line running or tie-back string 56. The main bore 50 of the main tubing hanger running tool 48 extends upwards through the mandrel 54, and the running string 56, bores 50, 32, and the production tubing 38 are all aligned. At the upper end of the mandrel 54 the main tubing; hanger running tool 48 provides connections shown generally at 58 for a control hose bundle 60. Ducts, to be described later and not shown in FIG. 1, extend from the connections 58 within the thickness of the mandrel 54 and into the body of main tubing hanger running tool 48 to supply hydraulic pressure from hoses of bundle 60 for all necessary control and testing functions. A deflector 61 is mounted on the top of the mandrel 60.

The main tubing hanger running tool 48 is formed with an entry cone 62 to guide the service line string 44 into the service line bore 52. As shown, the service line tubing hanger 40 is connected to a service line tubing hanger running tool 64 seated in the service line bore 34 of the main tubing hanger running tool 48, and this service line tubing hanger running tool is shown connected, at 65, to a 2" service line running or tie-back string 66. As with the production line, so the service line has the running string 66, running tool 64, service line tubing hanger 40 and service line tubing 44 all in alignment.

Figure 4:
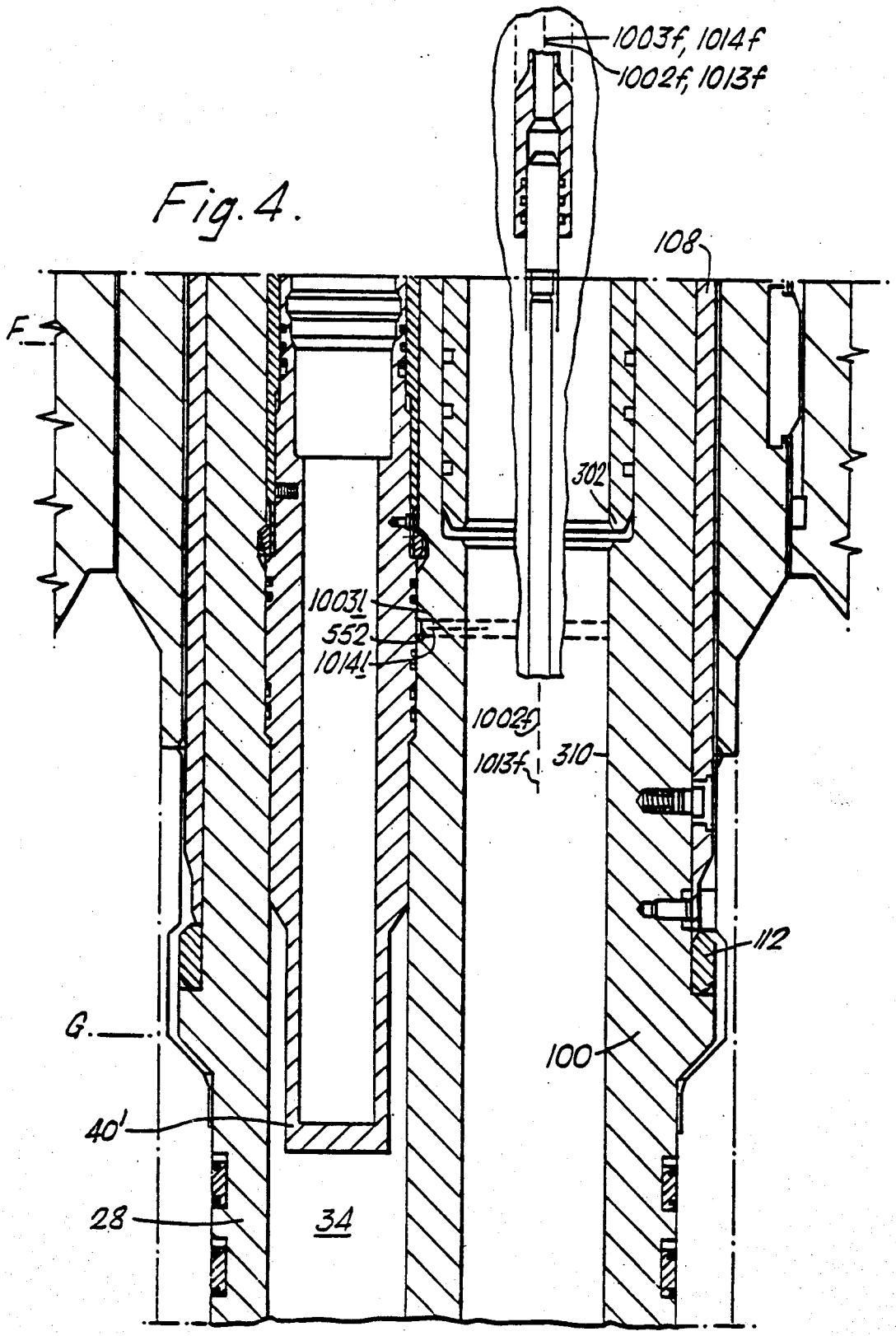
FIG. 4 is a sectional view similar to a part of FIG. 2 but showing a dummy service line hanger.

Operation of the apparatus so far described is as follows First, on the platform (not shown) a dummy service line tubing hanger 40' (FIG. 4) is inserted into the service line bore 34 of the main tubing hanger 28, to act as a plug therein. The dummy service line tubing hanger 40' is similar to the service line tubing hanger 40 except that the bore is closed and it is not intended to carry any tubing.

The main tubing hanger 28 is then assembled on a string of 4" production tubing 38, and connected to the main tubing hanger running tool 48. The control hose bundle 60 is connected to the connections 58 at the top of the mandrel 54. The main tubing hanger 28 is then landed on the lockdown seal assembly 26 with the aid of the running string 56, after orientation to predetermined position as it passes the orientation bushing 30.

As the production tubing 38 is being run down, control can be exercised by the variable bore pipe rams 18. When the hanger 28 is landed on the seal assembly 26 the main tubing hanger running tool 48 presents a cylindrical exterior surface 72 for cooperation with the 13⅜" casing ram 14.

The service line bore 34 in the main tubing hanger 28 is closed by the dummy service line tubing hanger 40'. The ducts in the mandrel 54 and body of the main tubing hanger running tool 48 (not shown in FIG. 2 but later described) allow hydraulic pressure to be delivered to piston areas so as to lockdown the main tubing hanger 28, and test the seals 70 between the main tubing hanger 28 and the seal assembly 26.

A retrieval tool (not shown) is now run down on a service line tubing running string 66 to enter the service line bore 52 and connect to the dummy service line tubing hanger 40'.

The dummy service line tubing hanger 40' is removed at the surface and after running the service line down hole 44 the service line tubing hanger 40 is connected to it. The 2" service tubing hanger running tool 64 is connected to the hanger 40 and the hanger run down on the service line running string 66 to land on the main tubing hanger 28. Hydraulic pressure is then applied to latch the service line tubing hanger 40 through the hoses of the bundle 60 and through the ducts in the mandrel 54 and running tools 48 and 64 to the main tubing hanger 28 and to test the seals 74 thereof.

At the same time the subsea safety valves may be set also by hydraulic pressure delivered through hoses of the bundle 60.

As the leading end of the 2" service line 44 is lowered into the bore 52 in the main tubing hanger, the deflector 61 moves the lower end so that it does not foul the top of the mandrel 54 while the entry cone 62 ensures that the lower end finds the service line bore 52.

It will be seen that the 4" production tubing 38 is installed first while the well is under the control of the variable bore pipe rams 18 and the 2" service line 44 is installed subsequently with the well under the control of the dual bore rams 16. Hydraulic pressure is transmitted through ducts in the main tubing hanger mandrel 54 so that the presence of these ducts does not interfere with the operation of the rams against the exterior of the mandrel.

Other lines may be connected to the main tubing hanger running tool, as will be later described.

When necessary, the service line tubing hanger running tool 64 can be unlatched by hydraulic pressure through hoses of the bundle 60 acting through the ducts in the mandrel 54. The service line running string can then withdraw, taking the service line tubing hanger running tool 64 with it. It will then be possible to apply hydraulic pressure through hoses of the control bundle 60 and ducts in the mandrel 54 to unlatch the main tubing hanger running tool 48, and this in turn can be lifted to the platform, the hoses being reeled in at the same time.

A Christmas tree (not shown) can then be lowered on to the main tubing hanger.

Figure 2C:
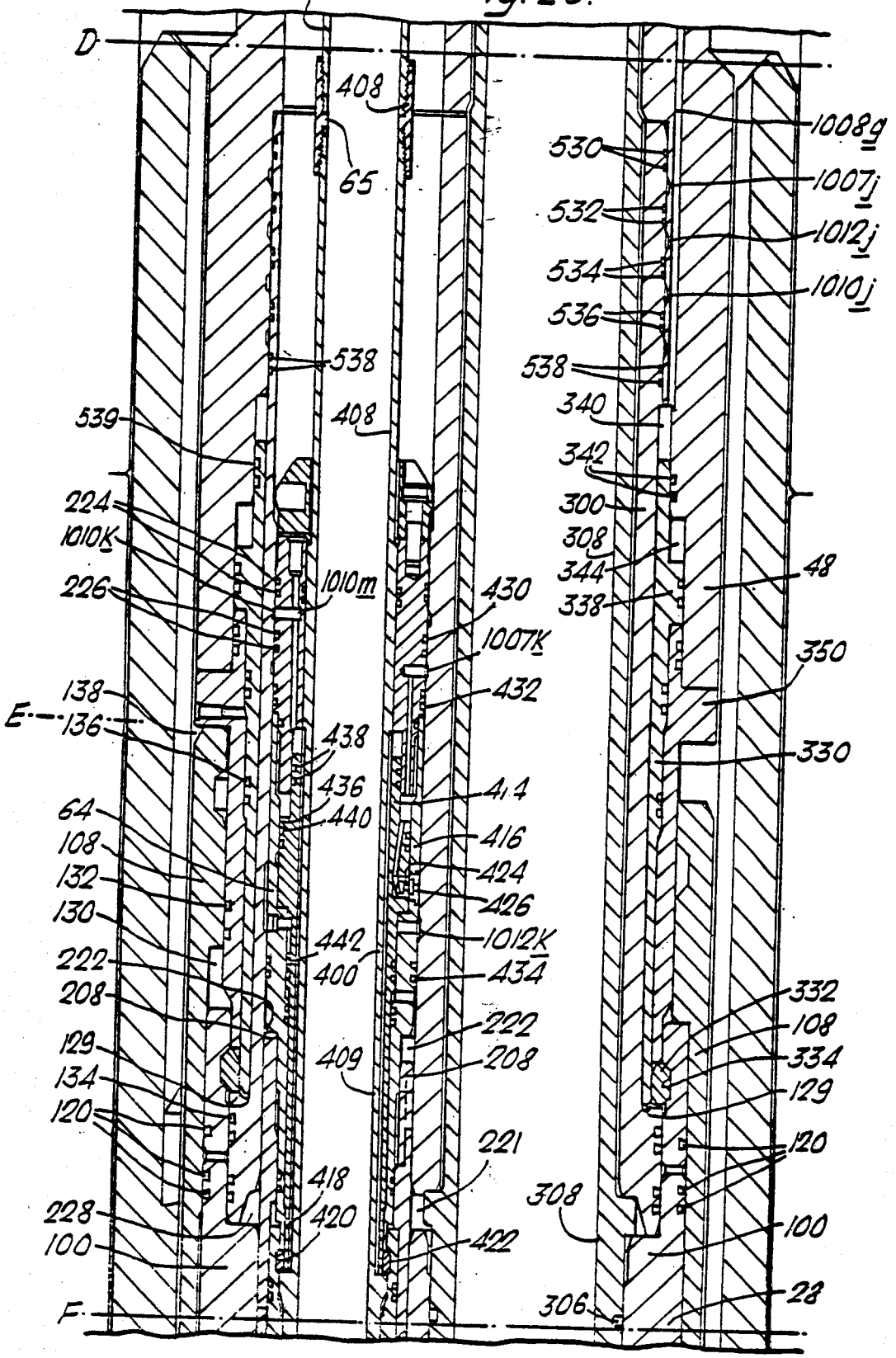
Figure 2D:
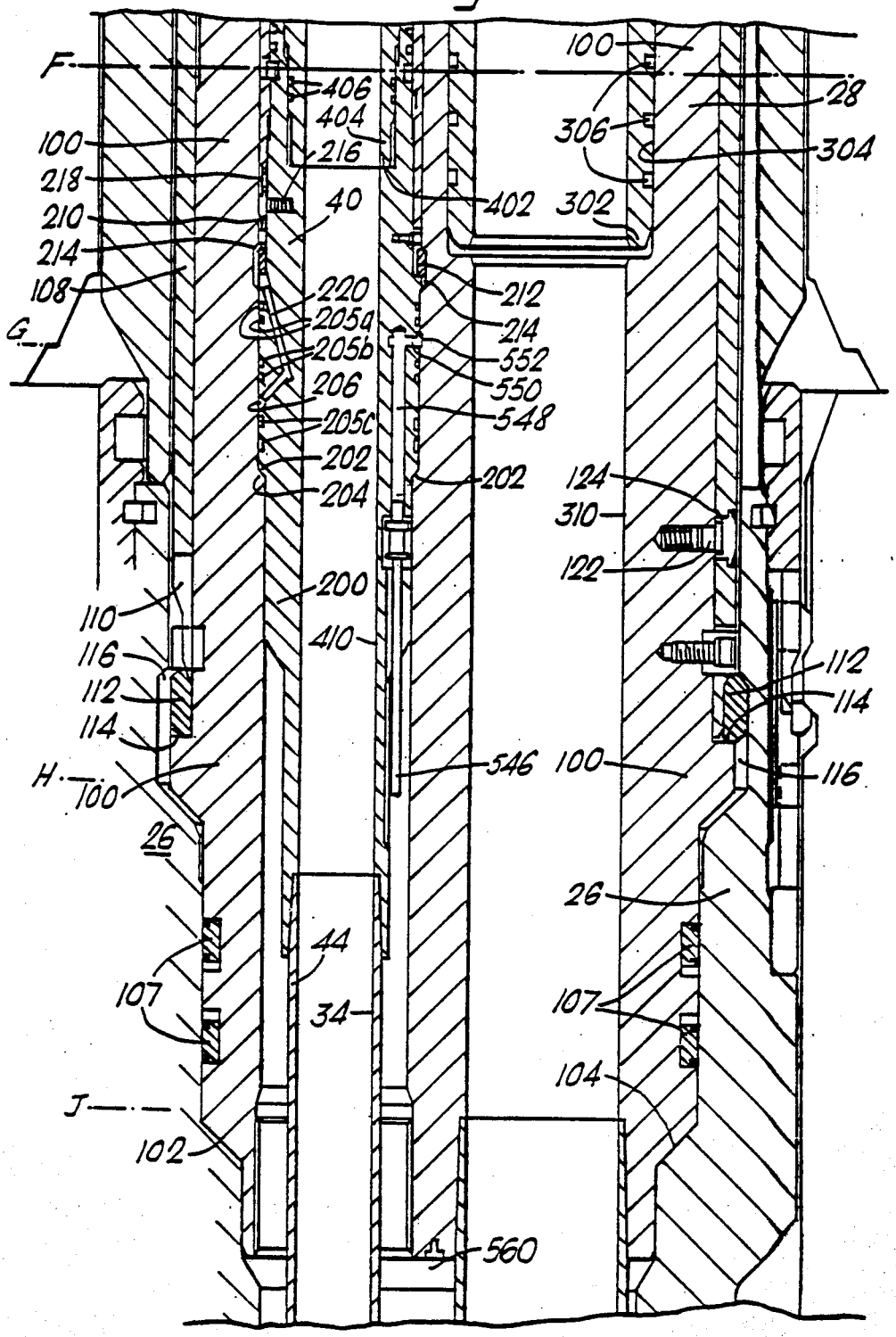

Reference is now made to FIGS. 2A, 2B, 2C and 2D, which, it is to be remembered, are to be assembled vertically and read together. As seen in FIGS. 2C and 2D, the main tubing hanger 28 has a body 100 with a frustoconical seating portion 102 at its lower end, seating on a corresponding surface 104 of the lockdown seal assembly 26. Above the seating surface 102 the hanger body 100 carries a pair of sealing rings 107 adapted to seal within a cylindrical bore 106 of the lockdown seal assembly 26; sealing rings 107 constitute the previously mentioned seal 70 (FIG. 1). At its upper end the hanger body 100 carries an actuating sleeve 108 whose lower end is formed as a series of cam fingers 110. A locking ring 112, which is a split ring, in its unactivated or retracted condition surrounds the body 100 of the tubing hanger against a shoulder 114 thereof and lies within the outline of the body and sleeve 108 so as to present no obstruction as the hanger is moved through the orienting bushing and lockdown seal assembly.

The sleeve 108 is movable between an upper or unlocked position as illustrated in the left-hand side of the FIG. 2C and the lower or locking position as illustrated in the right-hand side of that figure. In the unlocked position of the sleeve 108 the cam fingers 110 are clear of the locking ring 112 which then adopts its unactivated or retracted position. When the sleeve 108 is moved downward to its locking position the fingers 110 cam out the locking ring 112 so that it extends within a recess 116 in the lockdown seal assembly 26 and prevents upward movement of the tubing hanger. Sealing rings 120 are provided in the tubing hanger body 100 to form a seal between the body and the locking sleeve 108. Shear pins 122 located in bores within the hanger body 100 are spring-urged outwardly so that when the locking sleeve 108 moves to locking position, the shear pins move out into recesses 124 in the sleeve to prevent its retraction.

It will be assumed that the tubing string 38 and main tubing hanger 28 with the dummy service line tubing hanger 40' have been run down on the main tubing hanger running tool 48 until the seating surface 102 on the hanger lands on the seat 104 of the lockdown assembly 26. As the tubing hanger is run down, the sealing ring 112 is in its unactivated position. A key (not shown) on the hanger body 100 coacts with a cam surface (not shown) on the orientation bushing 30 to rotate it to a predetermined position as it is landed. It is now desired to test the sealing rings 107 and thereafter to lock the main tubing hanger 28 on to the lockdown seal assembly 26.

With the tubing string and hanger free-standing on the seat 102, the lower or casing blowout preventer rams 14 are clamped around the cylindrical surface 72 of the main tubing hanger running tool 48 and pressure is applied to the kill line. The annulus is thereby pressurized around the main tubing hanger. If the pressure applied is seen to fall off, it may be assumed that there is a leak at the sealing rings 107 and the hanger is removed for investigation. If the pressure is retained, then the sealing rings 107 are assumed to be functioning correctly and the hanger 28 may be locked down.

The hose bundle 60 provides hose connections to the surface for various hose connections 58 on the mandrel 54, among them one designated - UNLOCK - MAIN TUBING, with reference 1008. During the previous operation the hose connection 1008 is held closed. Connection 1008 leads to duct **1008*g* (see below) in the main tubing hanger running tool 48 which in turn connects through space 129 therein with space 130 as best seen in the left-hand side of the FIG. 2C. Sealing rings 132, 134 and 136 are provided on parts, to be described, of the main tubing hanger running tool 48. With the space 130 filled with liquid between sealing rings 132 and 134, 136 and 120 and prevented from escaping, the locking sleeve 108 on the hanger is prevented from moving to locking position. Once the sealing rings 107 have been tested and found satisfactory, connection 1008 is opened. The kill line pressure which is applied to the space 138 above the actuating sleeve 108 will move it to the locking position, as shown in the right-hand side of the FIG. 2C. The hanger body 100 is now locked down by virtue of the locking ring 112 extending into the recess 116 in the seal assembly 26**.

The hanger body 100 could be unlocked if required by applying pressure to the connection 1008, with the kill line pressure removed. This will move the sleeve 108 to unlocked position, shearing pins 122, and allowing locking ring 112 to retract.

Service line tubing hanger 40 is, as previously mentioned, run on the service line running tool 64 once the main tubing hanger 28 is locked down. The service line tubing hanger is generally similar to the main tubing hanger 28 so far as seating and lockdown features are concerned. The lower end of the tubing hanger body 200 has an annular frustoconical seating surface 202 seating on a corresponding seat 204 on the main tubing hanger body, in the service line bore 34 therein. The seal 74 previously mentioned is constituted by three pairs of sealing rings **205*a*, 205*b*, 205*c*, which all enter into sealing engagement with a cylindrical portion 206 of the service line bore 34 above the seat 204. Around the body 200 of the service line tubing hanger is an actuating sleeve 208 formed with cam fingers 210 at the lower end so that as the sleeve 208 moves from the unlocked position shown in the left-hand side of the figure, to the locked position shown in the right-hand side, the fingers 210 move a locking ring 212 from its inactive to its locking position in which it extends into an annular recess 214 in the service line bore 34 in the main tubing hanger 28. Spring-urged shear pins 216 on the hanger body enter holes 218 in the sleeve 208** when the latter is in locking position.

It will be assumed that the service line tubing 44 has been run down and the tubing hanger 40 has been landed on the seat 202; it is now desired to test the seal at sealing rings **205*a*, 205*b*, 205*c* before locking down the hanger. For testing purposes, bores 220 are formed in the hanger body 200 for communication between annular recess 214 and the annular space between sealing rings 205*b* and 205*c***.

With the service line tubing hanger 40 free-standing on the seat 204, the dual bore blowout preventer rams 16 are closed around the service line running string 66 and around the mandrel 54 on the main tubing line running tool 48. Pressure is now applied to the kill line and this pressure reaches the annular space 221 at the upper end of the hanger 40 through a duct (not shown). This pressure is transmitted along the service line bore to the recess 214 and thence through bore 220 to the annular space between the sealing rings 205*b*, 205*c*. If the pressure holds up the seals are satisfactory and the hanger is then locked down.

The hose connections 58, connected to the surface by hoses of the bundle 60, include one designated UNLOCK - SERVICE LINE TUBING HANGER carrying the reference 1010. This connection leads, by means to be described below, to an annular recess 1010*k* in the service line bore of the main tubing hanger running tool 48. Fluid pressure in the recess is sealed from the remainder of the bore by seals 224 and 226 in the service line tubing hanger running tool 64 and enters the service line tubing hanger running tool 64 at port 1010*m*. This pressure is communicated through the running tool 64 to the space 228. When the service line tubing hanger 40 is landed on its seat 204 pressure is applied to connection 1010 to hold the space 228 open, the sleeve 208 in its unlocking position, and the locking ring 212 in retracted position. Means not shown hold the sleeve 208 in unlocked position as the service line tubing hanger 40 is run down.

To lock the service line tubing hanger 40 on to its seat, connection 1010 is vented at the surface so that kill line pressure applied to space 222 moves the sleeve 208 to expand the locking ring 212 into locking position. The shear pins 216 then lock the sleeve 208.

The service line tubing hanger 40 can be unlocked by applying pressure to connection 1010, in the absence of kill line pressure applied to space 222. This shears the pins 216 and moves the sleeve 208 to unlocking position whereupon the locking ring 214 retracts.

The main tubing hanger running and testing tool 48 has a main body 300. A nose portion 302 offset from the main axis is adapted to enter a counterbore 304 at the upper end of the main tubing hanger body 100 and seal therein by seaing rings 306. The body 300 provides a bore 308 which is flush with the main bore 310 of the main tubing hanger body 100, and with bores of the production tubing 38 and running string 56. The mandrel 54 is for convenience of construction a separate member connected and seated to the main body 300 so as in effect to be integral with it. The main bore 308 is counterbored at 311 at its upper end, to receive a liner 312 to which it is sealed by rings 314 in the counterbore 311 and by rings 316 at the top of the mandrel 54. The liner carries a connection 320 for the running string 56. It is to be appreciated that while for purposes of the diagram of FIG. 1 a running string connection 55 is shown at the top of the mandrel 54, and this could be so arranged, it is preferred as here shown to have the connection above the top of the mandrel.

The body 300 of the main tubing hanger running and testing tool 48 carries an actuating sleeve 330 movable between an upper position and a lower position shown, in which the lower end of the sleeve actuates a latch ring 332 to a latching position in which it extends into an annular recess 334 in the body 100 of the main tubing hanger 28. In its upper position the sleeve 330 is withdrawn clear of the latch ring 332 and the latter retracts to free the running tool 48 for movement with respect to the hanger 28. Spaced from the upper end of the sleeve 330 is an integral flange 338. The upper end portion of the sleeve 330 moves within an annular bore 340 to which it is sealed by sealing rings 342 and the flange 330 moves in a counterbore 344 of the tool, in which it is sealed by sealing rings 346. An outer sleeve 350 surrounds the sleeve 330 and is fixed to the body 300 of the tool 48 so as to act as if an integral part of it.

The connections 58 at the top of the mandrel include two for operating the latch-actuating sleeve 330 of the running tool 48: these connections are designated LATCH - MAIN TUBING HANGER RUNNING TOOL, referenced 1005, and UNLATCH - MAIN TUBING HANGER RUNNING TOOL, designated 1011. It will be appreciated that pressure applied to connection 1005 is transmitted through ducts shown in part only at 1005*f* in the mandrel 54 and running tool body 300 to the space at the top of the counterbore 344, to actuate the sleeve 330 to latching position. Pressure applied to connection 1011 is transmitted through ducts shown diagrammatically only at 1011*f* to apply pressure to the underside of the flange 338 and thereby move the sleeve 300 to unlatched position.

As previously described the main tubing hanger running tool 48 has inter alia an entry cone 62 shaped to lead the dummy hanger 40' or service line string 44 into the service line bore 52. Further characters of the main tubing hanger will appear in the following description.

The service line running and testing tool 64 comprises a main body 400 with a nose 402 at its lower end to enter a counterbore 404 at the upper end of the service line tubing hanger 40. Sealing rings 406 in the running tool body 400 seal against the counterbore 404. The main body 400 of the hanger has an extension 408 formed at its upper end to provide a connection 65 for the service line running string 66. The body 400 provides a bore 409 flush with the bore 410 of the service line tubing hanger 40, and the bores of the service line 44 and the running string 66.

An actuating sleeve 414 surrounds the body 400 and an outer sleeve 416 encloses the actuating sleeve and is rigidly connected to the main body. The actuating sleeve 414 is movable between an upper position and a lower position as shown where fingers 418 at the lower end of the sleeve cam a latch ring 420 to project into an annular recess 422 at the upper end of the service line hanger body 200, thus locking the running tool 64 to the hanger 40. A shear pin 424 mounted in the actuating sleeve 414 extends into a recess 426 when, as shown, the sleeve 414 is in latching position.

The hose connections 58 on the mandrel 54 include two for operating the latch-actuating sleeve 414 of the service line hanger running tool 64. These connections are designated LATCH - SERVICE LINE TUBING HANGER RUNNING TOOL, referenced 1007, and UNLATCH - SERVICE LINE TUBING HANGER RUNNING TOOL, designated 1012. Pressure applied to these connections 1007 and 1012 from the surface through hoses is transmitted through ducts (not shown) in the mandrel 54 of the main tubing hanger tool 48 and thence through the main body 300 of the tool to annular recesses, respectively 1007*k* and 1012*k*, in the service line bore 52. Seals 430, 432 and 434 isolate the recesses 1007*k* and 1012*k* from each other and from the rest of the bore.

The actuating sleeve 414 has a flange 436 and the spaces above and below the flange are sealed by sealing rings 438, 440 and 442. Pressure applied to the connection 1007 is applied to the area at the top of the flange 436 to move the sleeve 414 to latching position. Pressure applied to the connection 1012 is transmitted to the underside of the flange 436 and is effective to move the sleeve to unlatching position after first shearing the shear pins 424.

Figure 3:
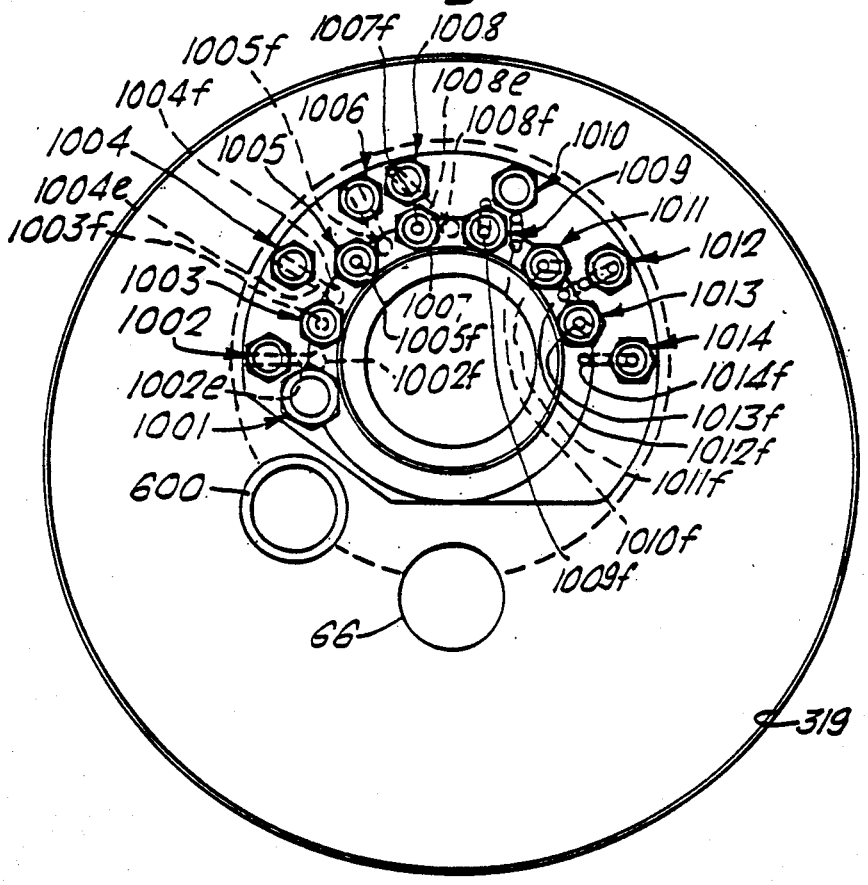
FIG. 3 is a plan view of the apparatus shown in FIG. 2.

Referring especially to FIG. 3, the hoses of the hose bundle 60 (not separately shown) are, as described above, brought down to connections designated generally 58 at a flange 500 at the top of the mandrel 54 on the main tubing hanger running tool. The connections are made up on the surface.

The connections 58 comprise the following:

1001: annulus monitor and test
1002: subsea safety valve (1) main tubing hanger
1003: subsea safety valve (1) service line tubing hanger
1004: test for lock—main tubing hanger
1005*: latch—main tubing hanger running tool
1006: spare
1007*: latch—service line tubing hanger running tool
1008*: unlock—main tubing hanger
1009: emergency unlatching—main tubing hanger running tool
1010*: unlock—service line tubing hanger
1011*: unlatch—main tubing hanger running tool
1012*: unlatch service line tubing hanger running tool
1013: subsea safety valve (2) service line tubing hanger
1014: subsea safety valve (2) main tubing hanger These connections marked * have been previously mentioned. All except 1001 are ¼" bore and connected, where needed through cross bores 1002*e*, 1004*e* etc. as shown, to longitudinal ¼" bores 1002*f*, 1003*f* etc. in the mandrel 54. Only one bore, 1008*f* appears in the section of FIG. 2A. These bores are required to transmit only small volumes of liquid: their main purpose is to transmit pressure.

Connection 1001 may however be required to transmit a volume of liquid and is of ¾" diameter, connected by a cross bore 1001*e* with the annular space 501 between the mandrel body 300*a* and the liner 312.

Figure 8A:
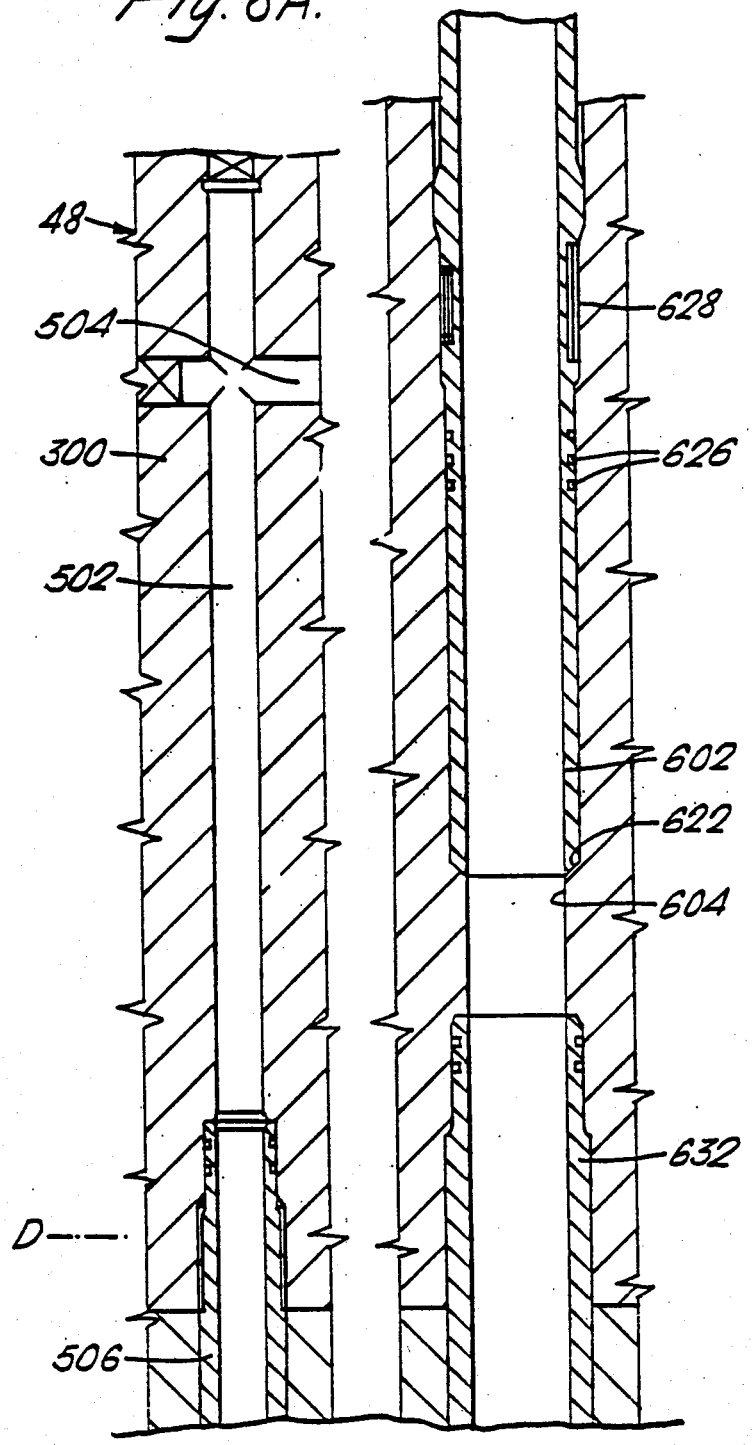
FIG. 8 is a part longitudinal section of the main tubing hanger running tool showing a secondary annulus access line, the figure being again in two parts 8A, 8B, to be read 8A above 8B.
Figure 8B:
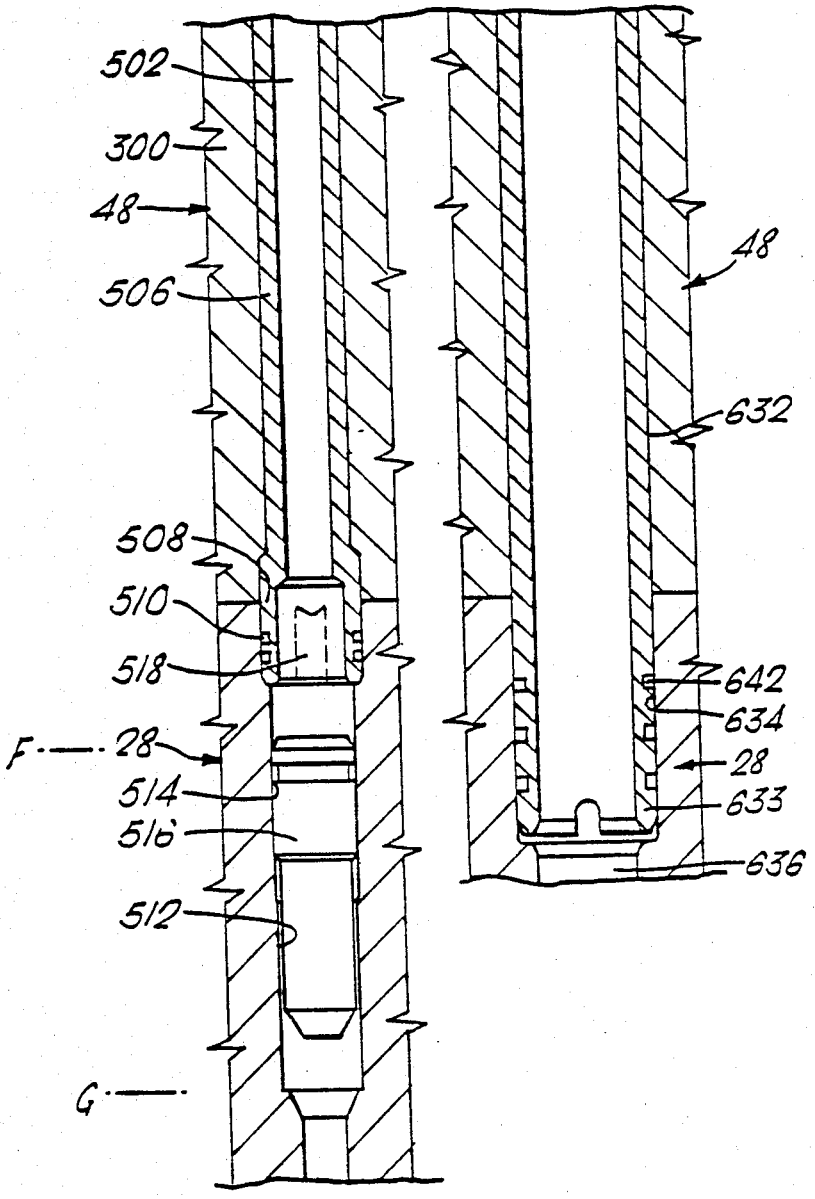

Turning first to the annulus monitor and test connection 1001, and referring to FIGS. 8A and 8B (read vertically 8A over 8B), a bore 502 is formed in the main tubing hanger running tool 48, which runs longitudinally with its axis in a plane behind that of FIG. 2. The bore 502 is connected by a cross bore 504 in the main tubing hanger running tool 48 with the lower end of the annular space 501 in the mandrel. The bore 502 is counterbored from its lower end to receive a tubular member 506 which terminates in a female connector element 508 carrying external sealing rings 510.

The main tubing hanger 28 is formed with a throughbore 512 aligned with the bore 502 and counterbored at its upper end 514 to locate a non-return valve designated generally 516 having a male connector 518 in its upper end. When the main tubing hanger running tool 48 connects with the main tubing hanger 28 the male and female connectors 508, 518 engage so that fluid applied to connection 1001 is transmitted through to the bore 512 and hence to the annulus.

The main purpose of the annulus monitor and test connection 1001 is to enable pressurization below the main tubing hanger 28 to test the sealing and locking of the tubing hanger 28 by pressure from below.

The connections for control of the main tubing hanger 28 and of its running tool 48 apply pressure through the ducts 1004*f*, 1005*f*, 1008*f*, 1011*f* in the mandrel previously mentioned and through ducts in the body 300 of the tool 48 connecting therewith. Only one of these ducts, 1008*g*, is shown connecting with the bore 1008*f* since these ducts 1008*g* and 1008*f* are the only ones which lie in the section plane of FIG. 2A. The point where pressure is applied from the other connections is illustrated for example at 1005*h* and the connecting ducts are omitted.

The connections which concern the service line tubing housing 40 and its running tool 64 are connected through bores 1007*f*, 1010*f*, 1012*f* through the mandrel 54 to annular grooves in the main tubing 300 of the tubing hanger shown at 1007*j*, 1012*j*, 1010*j* which grooves are separated from one another and from the surroundings by sealing rings 530, 532, 534, 536, 538. Ducts are formed in the body 300 of the main tubing hanger running tool 48 adjacent the service line bore 52 therein so as to connect with the annular recesses 1007*k*, 1010*k*, 1012*k* previously mentioned. The connecting ducts between for example the grooves 1007*j* and 1007*k* cannot be shown in FIG. 2 as they do not lie in the section plane of that figure.

The subsea safety valve connections 1002, 1003, 1004 connect with the corresponding ducts 1002*f* etc. in the mandrel 54 and then to ducts in a longitudinal axis which is not on the section plane of FIG. 2. These ducts all connect through male and female connectors 542, 544 to corresponding ducts in the main tubing hanger 28, when the running tool 48 and connector are engaged. The subsea safety valves are not shown but a line to connect to the service line subsea safety valve is shown at 546 connected into a bore 548 in the service line tubing hanger 40 and thence through a radial bore 540, 550 to an annular groove 552 in the main tubing hanger service line bore. The groove then connects with the ducts shown diametrally at 10031 and 10141 which in turn connect with the ducts not shown which lead down from the male subsea safety valve line connector 544. No main tubing hanger subsea safety valve is shown but a line such as 546 may be connected at the bottom of the main tubing hanger 28 at 560. For example with connections made to the corresponding ducts of the male connector 544 as described for the service line.

Figure 5:
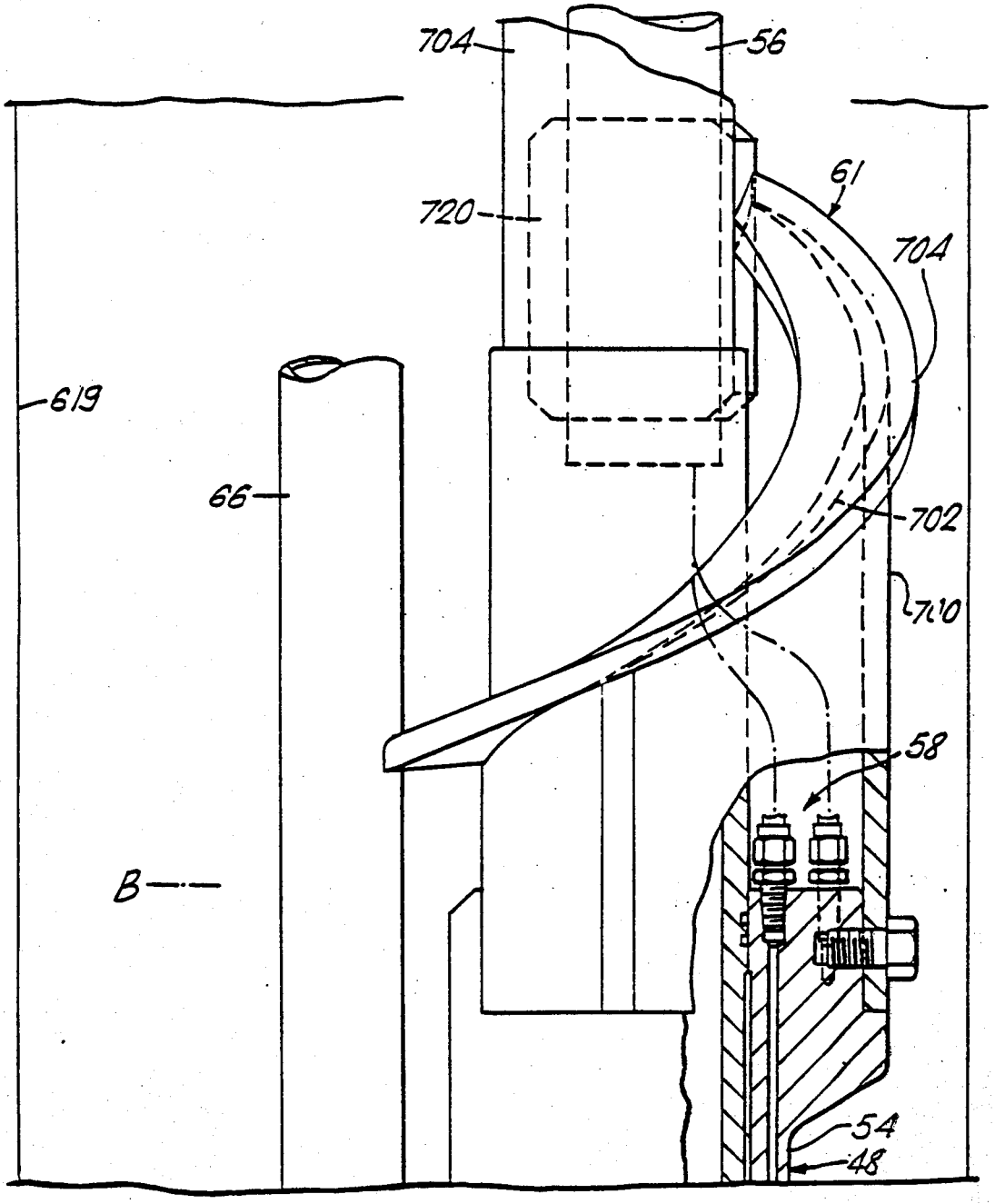
FIG. 5 is a partly sectioned side elevation of the top of the main tubing hanger running tool and running strings with a deflector mounted on the hanger.
Figure 6:
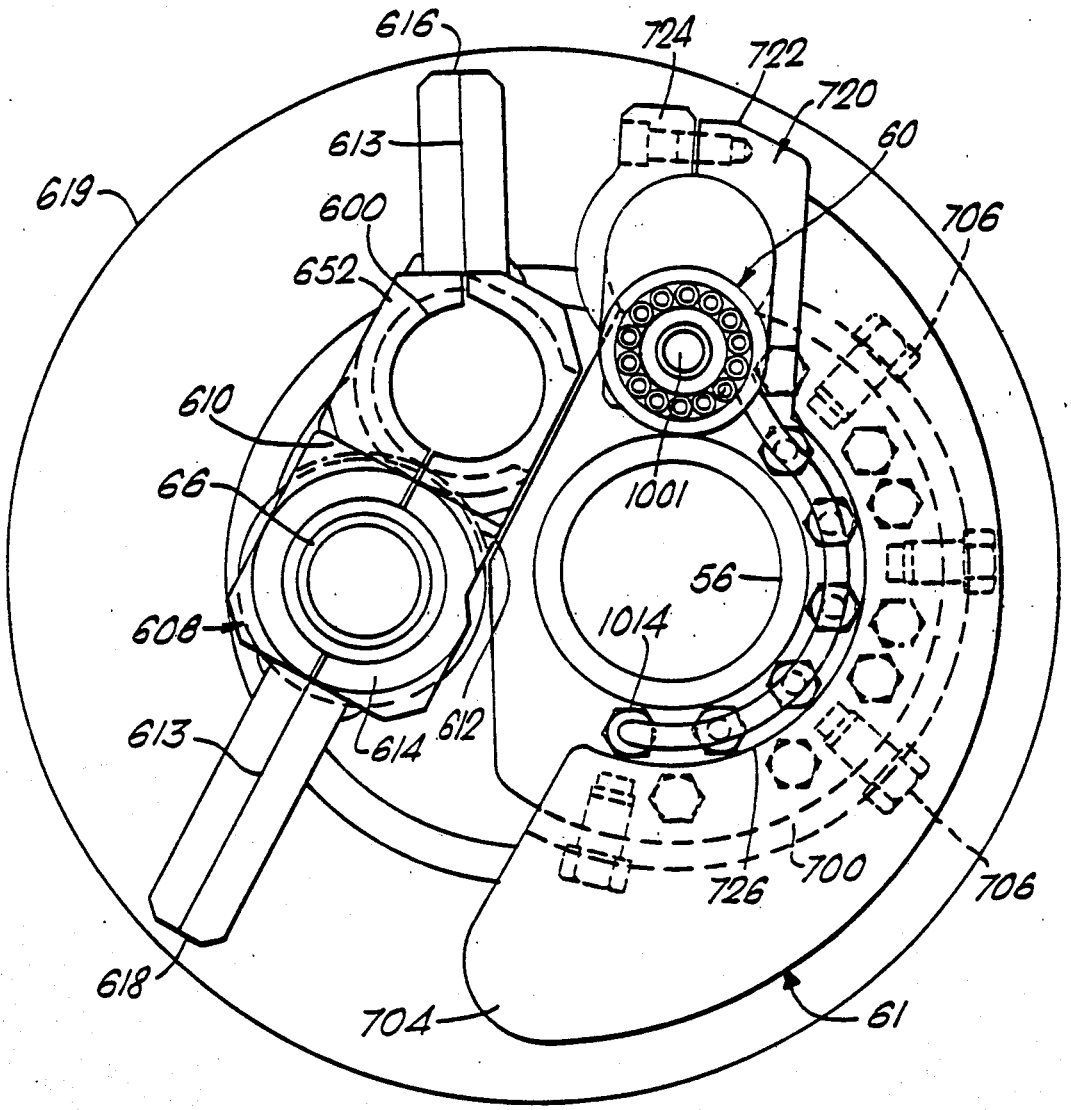
FIG. 6 is a part-sectional plan view of what is shown in FIG. 5, but illustrating also a guide clamp and control hoses.
Figure 7A:
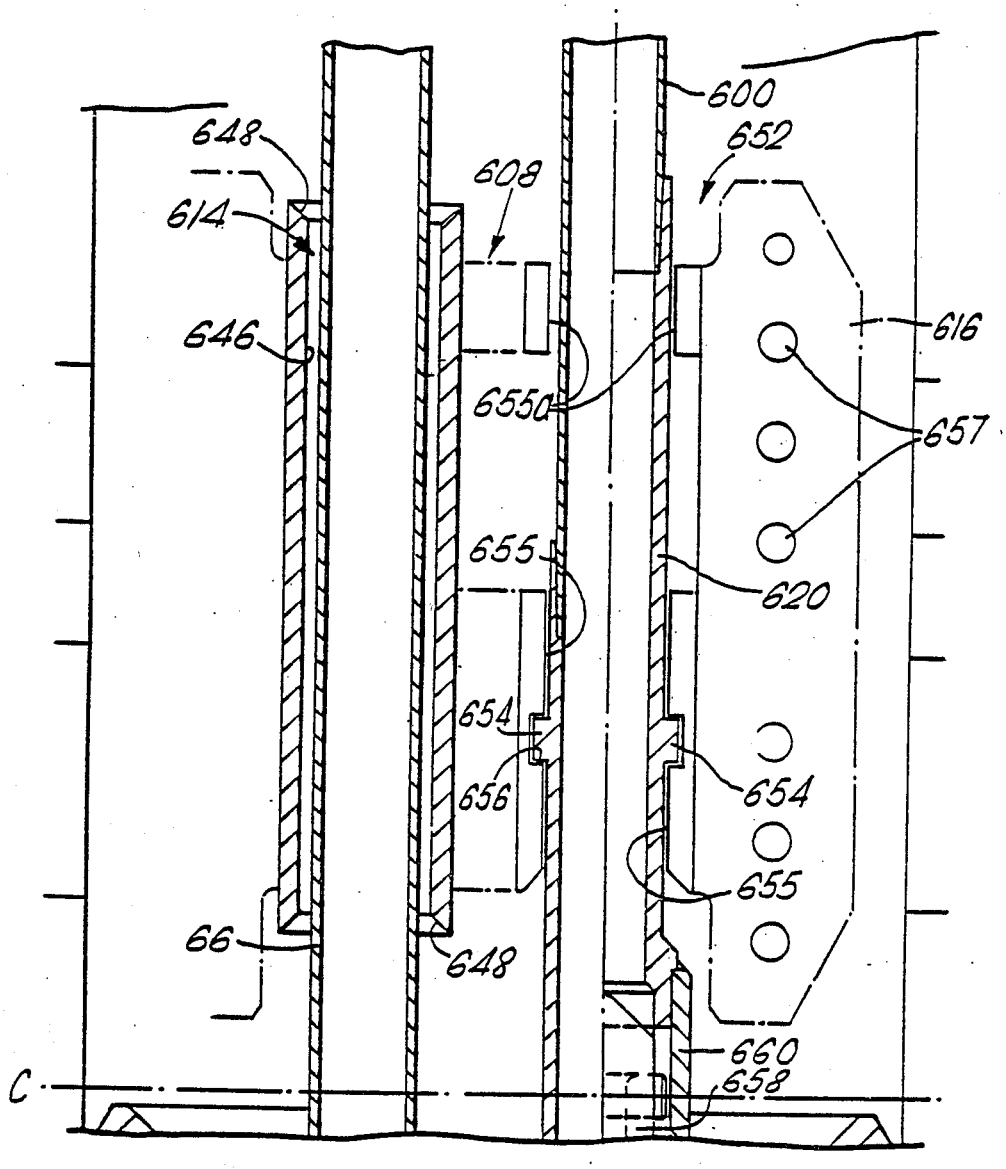
FIG. 7 is a longitudinal section, taken on intersecting planes indicated at VII—VII in FIG. 6, showing the guide clamp and, above the centerline, the full-bore annulus connector and a dummy mandrel, FIG. 7 being in two parts, 7A, 7B, to be read 7A above 7B.
Figure 7B:
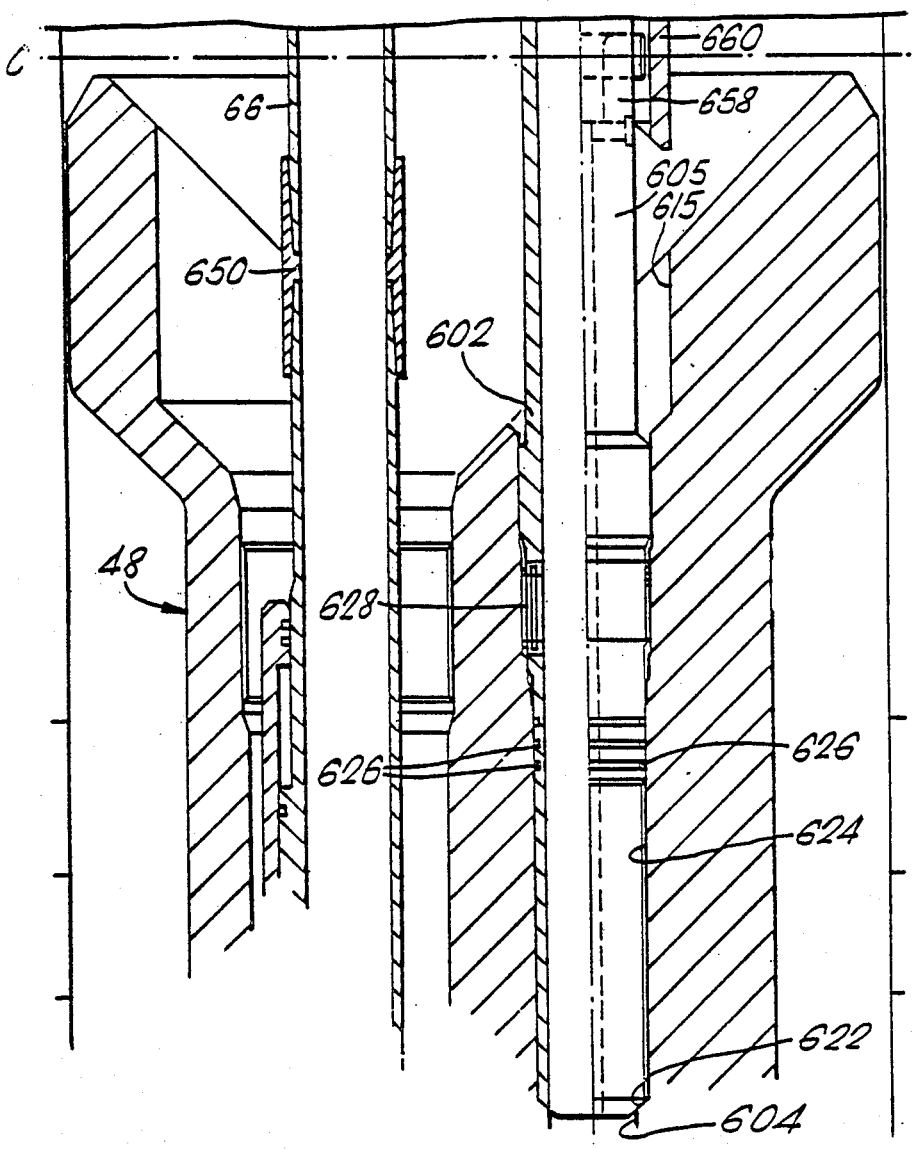

Referring particularly to FIGS. 5, 6 and 7 (with 7A read vertically above 7B), after the main tubing hanger running tool 48 and service line tubing hanger running tool 64 have been run down, a 2" full bore annulus access line 600 is connected to the main tubing hanger running tool 48, by means of a tie-back connector 602 received in an annulus access throughbore 604 formed in the tool (and shown to the left of the centerline of the bore 604 in FIG. 7). The main tubing hanger running tool 48 is run down with the bore 604 plugged by a dummy annulus mandrel 605 and this mandrel is retrieved after the service line tubing hanger running tool 64 and its running string 66 have been installed. (The mandrel is shown to the right of the centerline of bore 604 in FIG. 7).

The annulus access line 600, terminating in its connector 602, is lowered with a guide clamp designated generally 608 formed in two parts 610, 612 which are clamped together about the annulus access connector 602 before this is run down. The mating surfaces of these parts are shown by the angled line 613 in FIG. 6. The clamp has a portion 614 which is a loose fit around the service line running string 66 and end projections 616, 618 which fit loosely within the conductor tube indicated in FIGS. 5 to 7 at 619. It will be seen that the clamp 608 maintains the proper orientation of the annulus access line 600 as this is lowered so that it is received in the bore 604. An enlarged entry 615 around the top of the bore 604 allows for minor misalignment.

The clamp 608 is also used when the retrieving tool 620 (shown to the right of the centerline in the annulus access bore 604) is run down to retrieve the mandrel 605 prior to running the annulus access line, as described.

The annulus tie-back connector 602 seats on a frusto-conical seat 622 about bore 604 and extends into a counterbore 624 to be sealed therein by sealing rings 626. Located in the counterbore 624 above the sealing rings 626 is a ratchet latch which holds the connector 602 in assembled condition with the tool 48. Ratchet latches are known in the art and comprise an expandible (left-hand) female thread cooperating with a rigid male thread; it will be understood that the connector 602 stabs straight through the latch but can only be removed by unscrewing.

The bore 604 is counterbored at its lower end at 630 (see FIG. 8) to receive a tubular member 632 providing a male connector 633 to enter a corresponding female recess 634 in the main tubing hanger 28. This recess is a counterbore of a bore 636 in the tubing hanger 28 to which is connected at its lower end at 637 a pipe 638 shown plugged at 640 at its lower end. The male connector 632 is sealed within the recess 634 by sealing ring 642, when the main tubing hanger running tool 48 is engaged with the main tubing hanger 28.

The portion 614 of the guide clamp 608 which surrounds the service line running string 66 defines a smooth cylindrical guide surface 646 with lead-in bevelled portions 648 at either end. The portion 614 has sufficient clearance around the string 66 to enable it to pass easily over the pipe connectors, one of which is shown at 650 and the bevelled portions 648 enable the portion 614 to align with the axis on passing these connectors.

The clamp 608 has a portion 652 engaging snugly around the annulus tie-back connector 602 but permitting rotation of the connector as required to disengage it from the ratchet latch 628. The connector 602 is formed with a projecting thrust ring 654 about its upper end. The clamp portion 652 has a cylindrical surface 655 to form a bearing in the connector 602 and the bearing surface is formed with a groove 656 in which thrust ring 654 engages. Because of the thrust ring, longitudinal movement of the connector 602 is transmitted to the clamp 608. An upper bearing surface 655*a* on the clamp portion 652 engages the retrieval or disconnecting tool 620, when the clamp is assembled thereon, but this surface does not cooperate with the tie-back connector 602. The projection 616 is shown with bolt holes 657 and similar holes are formed in the projection 618, whereby the two parts of the clamp 610, 612 are bolted together.

As described, the dummy annulus mandrel 605 plugs the bore 604 until the service line 66 is engaged. This mandrel 605 is similar to the connector in seating on the seat 622 and having sealing rings 626 sealingly to engage the counterbore 624. In addition the dummy mandrel 605 has male teeth to engage the ratchet latch 628. Dummy annulus mandrel 605 terminates at its upper end in a J-connector designated generally 658, such connectors being well known in the art. The retrieving or disconnecting tool 620 has a cooperating part 660 at its bottom end to engage the J-connector whereby to unscrew the dummy annulus mandrel from the ratchet latch 628 for removal to the surface. The retrieving or disconnecting tool 620 is also formed with a thrust ring designated 654, similar to that on the annulus tie-back connector 602. When the retrieving or disconnecting tool 620 is to be used, the guide clamp 608 is connected to it as described for the annulus tie-back connector 602. The clamp 608 moves longitudinally with the tool 620 by reason of the thrust ring, but the tool can rotate with respect to the clamp for removal of the mandrel.

It has been explained that the main tubing hanger running tool 48 has at the top of its mandrel 54 a deflector 61 to guide the service string 44 into the service bore 52 in the main running tool. This deflector 61 is shown in detail in FIGS. 5 and 6 and has a body 700 formed as a cylinder cut away over rather less than 180° of its circumference so that what remains embraces the circular part of the flange at the top of the mandrel 54. The cylinder is also cut away at its end to the profile indicated in dotted lines 702 in FIG. 5. A generally spirally shaped cam plate 704 is welded to the profiled end edge of the body 700. The deflector body 700 is secured to the flange at the top of the mandrel 54 by a series of bolts 706. The deflector 61 accordingly provides a guide for the lower end of the service line 44 as it is lowered down the conductor tube 619, so that however the end is lowered it will be guided to the bore 52.

FIG. 6 also shows how the control hose bundle 60 is arranged. It will be seen that individual hoses for the ¼" connections 1002 to 1014 are arranged around the hose for the ¾" connection 1001. The hose bundle is held below the top of the deflector by a clamp 720. One part 722 of the clamp 720 is welded to the deflector body 700 and another part 724 is bolted to it to clamp the hose bundle 60. The division of the bundle into constituent hoses is illustrated diagrammatically at 726 in FIG. 5 and one hose is shown at 728 in FIG. 6 running to connection 1014. The hose bundle 60 is held to the production running string 56 at intervals by ties not shown.

It will be appreciated that the construction so far described is simply one embodiment of the invention given by way of example and not of limitation. It will be appreciated that various changes in the construction can be made within the scope of the claims.

In some cases it may be desired to eliminate completely the annulus monitor and test arrangements, thereby eliminating connection 1001, bore 502 and associated ducts and connectors.

For deeper water applications, where free passage of the guide clamp may be impeded due to "wind-up" of the control hose 60 around the production string 56, an alternative operating method is provided for in the equipment design as follows:

after completion of production and service line strings 56, 66, the bores are plugged off below the main tubing hanger 28. The main running tool 48, with the service line running tool 64 assembled therewith, is then pulled back to surface, together with the orienting bushing 30. The annulus tie-back connector 602 is connected up to the top of the main tubing hanger running tool 48 at the surface and the assembly re-run as a triple string with stabs (not shown) fitted to both production and service line terminations under the tool for re-entry to the tubing hanger. A special orienting sleeve (also not shown) is fitted around the running tool 48 to facilitate re-entry. The running tool 48 is then re-latched to the tubing hanger to enable downhole work to proceed.

Figure 9:
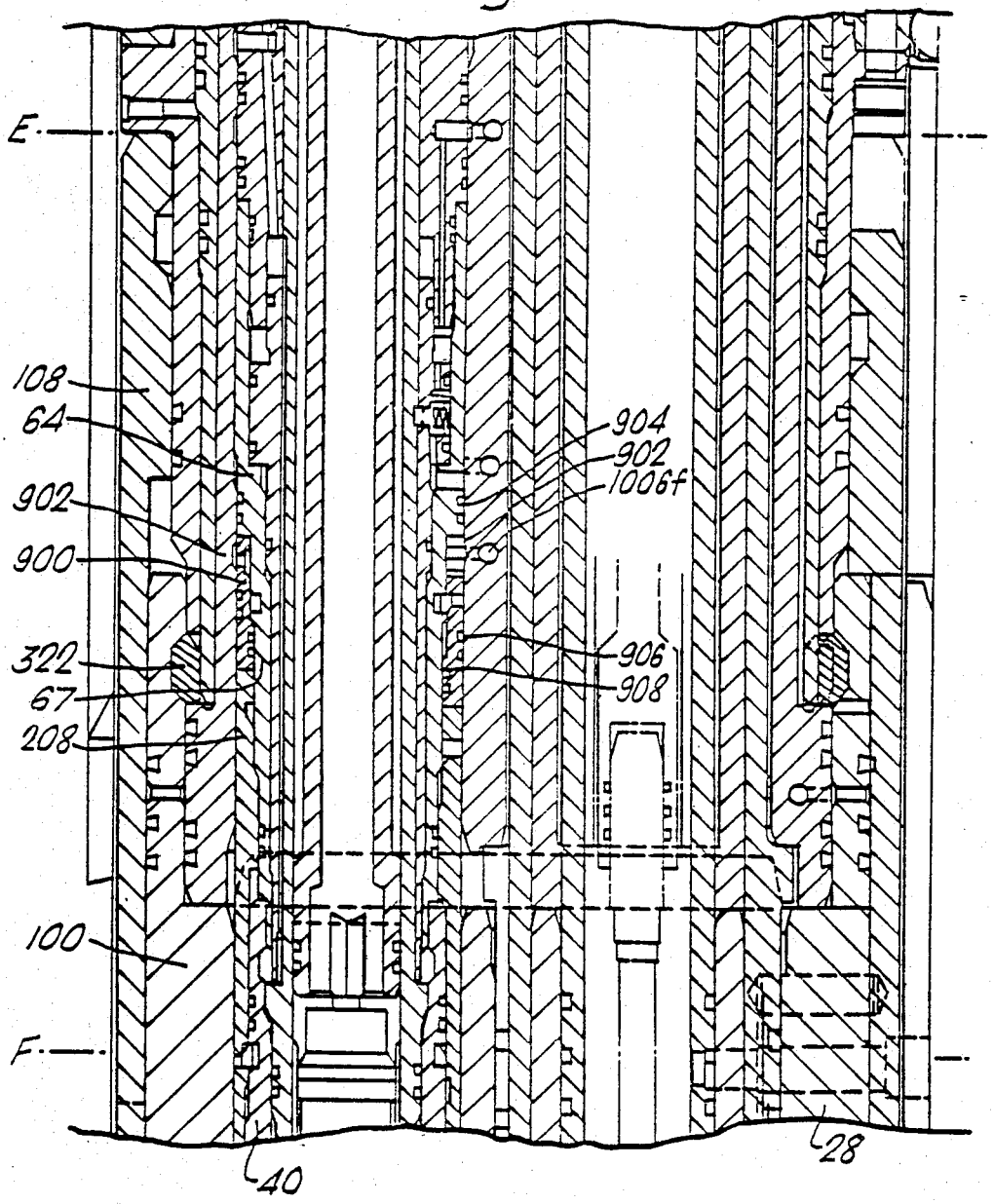
FIG. 9 is a part longitudinal section showing a part of a modified service line running tool with an alternative locking arrangement for the service line hanger.

An alternative construction, to allow locking of the service line tubing hanger 64 by different means, is illustrated at FIG. 9, which is partial section of the tubing hanger and the modified running tool 40'. The section corresponds to that of FIG. 2*c*, but shows only the relevant part of the running tool and adjacent portions of other parts. The reference numerals used in FIG. 9 are the same as those used in FIG. 2*c* for similar parts and these will require no further description. In FIG. 9 only those parts will be described which are different from those of FIG. 2*c*.

Referring now to FIG. 9, a sleeve designated generally 900 surrounds the part 67 of the service line running tool 64 and with the running tool latched to the service line tubing hanger 40 the sleeve is movable from the position illustrated to the left of the centerline to that shown on the right. The connection 1006 shown in FIGS. 2 and 3 and labelled "spare" is in this modification used for locking the service line tubing hanger. Liquid from the connection 1006 is led to an annular recess 902 in the service line bore of the main tubing hanger 28 which is isolated from its surroundings by sealing rings 904, 906, 908. It will be seen that pressurizing the recess 902 applies pressure to the annular area above the sleeve 900 so as to move it downwards, thereby to move the part 208 so that the cam fingers 210 cam the locking ring 212 on the surface line tubing hanger into locking position in recess 214.

What is claimed is:

1. A method for completing a well having production and service strings of different sizes including the steps of running the production string on a main tubing hanger and maintaining control with a variable bore blowout preventer and then running the service string into the main tubing hanger and maintaining control with a dual bore blowout preventer with the two strings oriented.

2. A method of completing a well by production and service strings of different sizes, comprising the steps of running the production string on a main tubing hanger with the aid of a main running and testing tool having an upward tubular extension which, when the hanger is seated, extends upwardly through a dual bore blowout preventer and contains all necessary hydraulic pressure ducts for testing and control, maintaining control by the variable bore preventer, testing the main tubing hanger seals, then running the service string on its own service line tubing hanger with the aid of a service line running and testing tool, the service line tubing hanger seating in the main tubing hanger with ports in the running tools and hangers aligned, maintaining control by the dual bore preventer, and testing the service line hanger seals pressure applied through said ducts in the main tubing hanger extension.

3. A method of completing a well having production and service strings of different sizes, supported on a main tubing hanger having offset main and service bores aligned with the respective strings, comprising the steps of (1) plugging the service line bore of the main tubing hanger, (2) running the production string on the main tubing hanger with the aid of a main running and testing tool having aligned with the main bore an upward tubular extension which contains all necessary hydraulic pressure ducts for testing and control, and presents an unencumbered generally cylindrical exterior, (3) through step (2) maintaining control by a variable bore blowout preventer cooperating with the hanger extension, (4) testing the main tubing hanger seals, (5) removing the service line bore plug, (6) running the service string into the service line bore on its own service line tubing hanger with the aid of a service line running and testing tool, the service line tubing hanger seating in the main tubing hanger with ports in the running tools and hangers aligned, (7) testing the service line hanger seals by pressure applied through said ducts in the main tubing hanger extension, and (8) through steps (6) and (7) maintaining control by a dual bore blowout preventer cooperating with the hanger extension.

4. A method as claimed in claim 2 or claim 3, including the steps of running a full bore annulus tie-back string into a pocket on the main tubing hanger running tool with the aid of a guide member on the tie-back string extending with clearance around the service tie-back line.

5. A main tubing hanger comprising (1) means for attachment to a lockdown seal assembly, (2) a main bore offset with regard to the hanger axis, means centered on the main bore for connection to a production string, (3) means centered on the hanger axis for connection to a main tubing hanger running tool, and (4) a service line bore providing means for locating a service line tubing hanger and for receiving a service line tubing hanger running tool.

6. A main tubing hanger as claimed in claim 5 further including duct means to convey hydraulic pressure to port means to register with ports in the service line tubing hanger.

* * * * *